US006102843A

United States Patent [19]

Kelley et al.

[11] Patent Number: 6,102,843

[45] Date of Patent: Aug. 15, 2000

[54] FLOW ENHANCED ONE-PASS CENTRIFUGE SEPARATOR

[75] Inventors: Lonny R. Kelley; Mark E. Ehrhardt; Mukhtiar S. Purewal, all of Houston, Tex.; Jeffrey W. Frederick, Morris Plains, N.J.; Houston G. Wood, III, Charlottesville, Va.; James P. Johnston, Palo Alto, Calif.

[73] Assignee: ExxonMobil Upstream Research Company, Houston, Tex.

[21] Appl. No.: 08/619,862

[22] Filed: Mar. 19, 1996

Related U.S. Application Data

[63] Continuation of application No. 08/154,043, Nov. 17, 1993, abandoned.

[51] Int. Cl.[7] ..... B04B 1/04; B04B 11/00; B04B 15/06

[52] U.S. Cl. ..... 494/29; 494/56; 494/66; 494/79; 494/80; 494/900

[58] Field of Search ..... 494/22, 27, 29, 494/30, 43, 56, 74, 79, 80, 900, 67, 66

[56] References Cited

U.S. PATENT DOCUMENTS

| | | | |
|---|---|---|---|
| 450,391 | 4/1891 | Wahlin | 494/80 X |
| 508,744 | 11/1893 | Ohlsson | 494/74 X |
| 561,829 | 6/1896 | Springer | 494/79 X |
| 801,069 | 10/1905 | Fleming | 494/900 X |
| 1,222,979 | 4/1917 | Okell | 494/79 X |
| 3,445,061 | 5/1969 | Nilson . | |
| 3,791,575 | 2/1974 | Kartinen et al. . | |
| 3,960,319 | 6/1976 | Brown et al. . | |
| 3,963,175 | 6/1976 | Daubman et al. | 494/80 X |
| 3,971,509 | 7/1976 | Johnsen | 494/27 |
| 4,044,943 | 8/1977 | Brown et al. . | |
| 4,846,780 | 7/1989 | Galloway et al. | 494/3 |
| 5,209,765 | 5/1993 | Kolpak et al. . | |

*Primary Examiner*—Charles E. Cooley
*Attorney, Agent, or Firm*—S. P. Koch; P. G. Woo

[57] ABSTRACT

A one-pass centrifuge separator for mixtures of two liquids which may also contain gas. The centrifuge uses separation zones on a rotor's inner wall to improve separation efficiency and minimize turbulent mixing. The zones consist of surface and interface vanes, and baffle plates to control flow at the fluid interface. The zones also retain an open concept to facilitate washing by cleaning fluids which are provided by nozzles installed on a stationary feedpipe mounted along the rotational axis of the centrifuge. A fluid accelerator gradually accelerates the fluid from the feedpipe to the inner wall of the rotor.

23 Claims, 11 Drawing Sheets

98
97
90
82
95
82
76
83
96
92
74
94
88
85
80
208
98
86
84

110
62
68
24
23
64
21
62
110
20
70
58
22
60
58
21
66
110
56
56

77
77
52
38
5
5
56
56
43
11
11
77
41
77
44
54
9
9
42
51

49
19

FLOW ENHANCED ONE-PASS CENTRIFUGE SEPARATOR

CROSS REFERENCE TO RELATED APPLICATION

This application is a continuation of patent application Ser. No. 08/154,043, filed Nov. 17, 1993, now abandoned

FIELD OF THE INVENTION

The present invention relates to an apparatus for separating the components of a mixture of fluids. Specifically, but not by way of limitation, the invention pertains to an apparatus for enhancing the efficiency and simplifying the operation of centrifugal separators.

BACKGROUND OF THE INVENTION

Centrifuge separators are frequently used to separate mixtures containing fluids of different densities. In operation, centrifuges generally involve feeding the mixture to be separated into a cylindrical rotor capable of being rotated about its central axis at high speed. Centrifugal force causes the components to collect in layers along the inner wall of the rotor. The layers are then individually removed from the rotor.

A number of different parameters are used to characterize the operational efficiency of centrifugal separators. One such parameter is the volume of the input mixture which can be treated in a given time period. For example, oilfield separation volumes are stated as a number of barrels per day of the input mixture which can be separated.

Other parameters characterize efficiency in terms of the quality of the separated fluids. These parameters are stated as a percentage, or as a number of parts per million, of impurities in each separated fluid. In oilfield separation, where the mixture to be separated contains crude oil and water, the typically computed impurity parameters are the amount of water remaining in the separated oil, and the amount of oil remaining in the separated water. Of these two parameters, the oil remaining in the separated water is typically the parameter whose target value is more difficult to attain. Most common centrifuge separators attain satisfactory water in oil impurity levels.

The challenge in the centrifuge art is to develop separators which maximize the volume of a mixture treated in a given time period, while simultaneously minimizing the impurities in the output fluids. This challenge is particularly acute in the oilfield production setting, where high daily volumes must often be separated. For example, oilfield production separators often must separate several thousand barrels of liquids per day. Despite these high volumes, regulatory, environmental, and refinery constraints all generally require the separated fluids to have minimum impurities. A typically quoted requirement for the amount of oil in water is 40 parts per million.

The problem that the centrifuge designer faces is that the maximum volume and minimum impurity goals to some extent involve conflicting technical considerations. For example, increasing the throughput volume on typical centrifuge designs is not always possible, and, where possible, may create undesirable flow characteristics within the centrifuge rotor. These result from the fact that the input mixture must be quickly accelerated to the speed of the rotor. The flow characteristics may include unsteady or turbulent flow regimes, vortex shedding, mixing or shear flow zones, fluid interfacial instabilities, and the like. None of these impact throughput volume, but they all may impact output fluid quality. More specifically, it is generally understood in the centrifuge art that any flow process that tends to increase fluid mixing or turbulence, or cause dissimilar motions between the particles of the fluids to be separated, increases the level of impurity in the output fluids. Therefore, existing centrifuges generally involve a tradeoff between throughput volume and separation efficiency.

An additional complication that sometimes faces separation equipment used in oilfield production is dissolved matter in the input mixture. Production mixtures may contain wax and other matter, which, as a result of the generally high temperature of the mixture, is in solution form. As the separation process occurs, however, that wax may form deposits on internal portions of the separator, reducing both volume and impurity efficiency. Oilfield centrifuges may also be subject to the internal accumulation of sand or solids which also reduce separation efficiency.

U.S. Pat. No. 4,846,780 to Galloway et al. ("Galloway") is an example of a prior art centrifuge separator. In its principal embodiment, Galloway uses a liner along the inner wall of the rotor to create a two pass separation process. The liner creates a complex passageway in which wax and other matter may gather, ultimately reducing separator s efficiency. Input to the Galloway centrifuge is via a nozzle which sprays fluids into an impeller for acceleration out to the inner wall of the rotor. Flow out of the nozzle is not tightly controlled, however, and is a highly turbulent process. The Galloway centrifuge can be fabricated as a one pass separator without the complex passageway, but the level of impurity of the separated fluids is increased accordingly.

From the foregoing, it can be seen that a centrifuge separator is needed that does not sacrifice separation is efficiency for throughput volume, that does not involve complex fluid flow patterns, that minimizes fluid mixing and turbulence during the separation process, and that involves simplified internal passageways which promote cleaning and minimize the deposition of solid matter. The present invention satisfies that need.

SUMMARY OF THE INVENTION

The present invention is a flow enhanced centrifuge separator designed for one pass operation. The flow enhancements ensure that efficient separation occurs while mitigating the problems discussed above.

A first embodiment of the invention is directed at input mixtures consisting of two fluid components, which may contain gas, but which does not have a significant amount of particulate matter. According to this embodiment the fluid to be separated exits the nozzle of a stationary feedpipe near the axis of a rotor. The fluid enters an accelerator having helical channels which gradually accelerate the fluid out to the inner wall of the rotor. The fluid exits the channels and flows through a slotted feed baffle installed in the rotor.

Inside the rotor, mixing and turbulence are minimized by coalescence vanes. Zoning baffles attached to the vanes create separation zones which aid separation and minimize flow at the fluid interface between layers. Barrier rings installed on the zoning baffles and at the location at which the separated layers are removed from the rotor facilitate removal of the layers, which is performed by standard weir techniques.

The stationary feedpipe includes high pressure nozzles which allow cleaning fluids to be sprayed into the rotor. The coalescence vanes are designed such that substantially all portions of the separation zones are accessible to the cleaning fluids.

A second embodiment of the invention is directed at mixtures in which wax, sand or other matter, as well as gas, are expected to be present. This embodiment involves a conical accelerator shell with vanes on the shell's inner wall to aid acceleration of the fluid out to the rotor's inner wall. Particulates collect inside the shell and are removed by suction force from debris piping mounted inside the stationary feedpipe and extending into the shell. This embodiment is otherwise similar to the embodiment discussed above. In both embodiments, gas, if present, may be vented into the rotor and removed by a feedpipe gas port.

BRIEF DESCRIPTION OF THE DRAWINGS

The advantages of the present invention will be more easily understood by referring to the following detailed description and the attached drawings where.

Figures 1, 2, 7, 12:
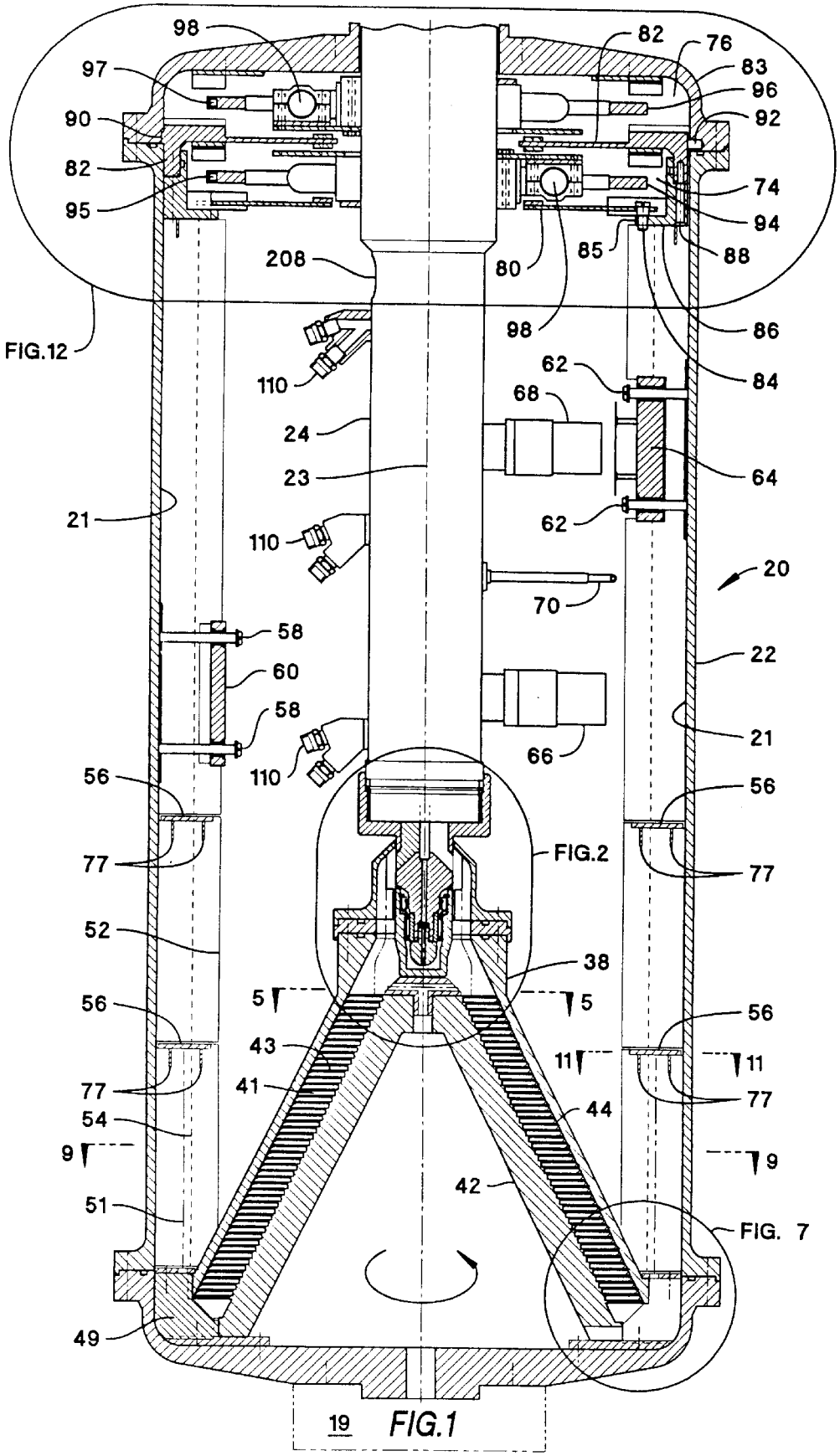
FIG. 1 is an elevation view, in partial section, of the first embodiment of the present invention.
FIG. 2 is an enlarged elevation view in partial section of the feedpipe nozzle of the first embodiment of the present invention.
FIG. 7 is an enlarged elevation view in partial section of the feed baffle of the present invention.
FIG. 12 is a partial elevation view of the oil and water weir chambers of the present invention.

Although the invention will be described according to its preferred embodiments, such descriptions shall not limit the invention. Accordingly, the invention is intended to encompass all alternatives, modifications, and equivalents which may be included within the spirit and scope of the invention, as defined in the appended claims.

DESCRIPTION OF THE PREFERRED EMBODIMENTS

The present invention is a flow-enhanced, one-pass centrifuge separator. The flow enhancements enable efficient separation to occur while mitigating the problems discussed above. Although the invention will be described in reference to the separation of oil and water in the oilfield production setting, the invention may encompass other uses. To the extent the description is specific to a particular use, it is intended only as illustrative and is not intended to be limiting.

In a first embodiment, the invention includes a) a rotor mounted so as to allow rotation around a central axis, b) driving means to provide power for that rotation, c) an accelerator which gradually accelerates the fluid out to the inner wall of the rotor, d) separation vanes mounted on the inner wall of the rotor, and e) means for removing the individual separated layers from the rotor. This embodiment of the present invention is most suited to input mixtures having minimal amounts of dissolved matter and particulates. The mixture may include solution gas.

In operation, the present invention has a number of improvements over the prior art. In one embodiment, the fluid to be separated exits a fluid supply nozzle in a controlled flow pattern near the axis of rotation of the rotor. Fluid input to the accelerator in that manner is an improvement over the prior art which minimizes both shear zone creation and the fluid mixing which results from sudden exposure to rotational forces.

The accelerator has helical channels which gradually accelerate the fluid out to the inner wall of the rotor through frictional forces imparted by the walls of the channels. This improvement over the art minimizes the possibility that large fluid particles in the input mixture will be subject to forces causing breakdown into smaller particles. Minimization of large particle breakdown improves output fluid quality.

The helical channels also enable a steady fluid flow to be maintained into the rotor, and allow the fluid's rotational velocity leaving the accelerator to approach the rotational velocity of the rotor. This improvement in the relative difference in rotational velocity over the prior art reduces turbulence in the rotor.

Mixing at the exit of the channels may optionally be minimized by a feed baffle installed in the rotor. The feed baffle has a slot at the approximate location of the interface between the two liquid layers, minimizing relative circumferential motion of fluid particles.

No prior art centrifuge incorporates the present invention's separation zone attributes. Fluid flow is controlled by separation vanes and zoning baffles which create separation zones in the rotor and aid separation by minimizing shear flow at the interface between layers. The zoning baffles increase the reliability of the fluid level detection and control system by simplifying the flow patterns around the fluid level floats. The zoning baffles also isolate the bulk separation process occurring near the feed baffle from the fine particle separation occurring near the exit of the rotor.

Cross-facial fluid mixing may also be minimized by barrier rings installed on the zoning baffles and also at the location of the weirs at which the layers are removed from the rotor. Because the zoning baffles force flow to occur only near the inner wall of the rotor and near the surface of the lighter fluid layer, radial flow is minimized thus eliminating mixing at the weirs. No prior art separator incorporates this enhancement.

In one embodiment of the present invention, the separation vanes run longitudinally along the inner wall of the rotor without interruption except at the location of the zoning baffles, if present. In an alternate embodiment, the vanes are installed longitudinally along the inner wall in staggered sections. This embodiment, which may also include zoning baffles, increases fluid coalescence by creating flow stagnation points.

Referring now to FIG. 1, centrifuge 20 consists of rotor 22 and feedpipe 24 mounted inside a suitable outer housing (not shown). Driving means 19 enable rotor 22 to rotate around central axis 23 of rotor 22. Feedpipe 24 is rigidly attached to outer housing (not shown) and does not rotate with rotor 22.

Figure 3:
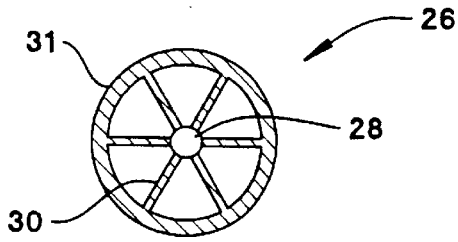
FIG. 3 is a plan view of the first embodiment taken along line 3—3 of FIG. 2.
Figure 4:
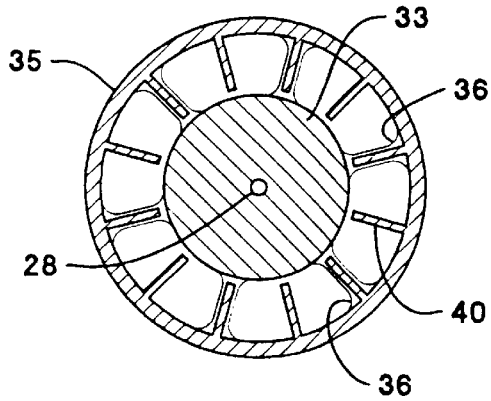
FIG. 4 is a plan view of the first embodiment taken along line 4—4 of FIG. 2.

As best shown in FIG. 2, mixture to be separated exits nozzle housing 31, which is attached to the end of feedpipe 24 by screw threads (as shown), welding, or other known means. As shown in FIG. 3, feedpipe nozzle 26 consists of nozzle spokes 30 and nozzle housing 31. Mixture exits nozzle through openings between spokes 30, and, as shown in FIG. 2, is directed by cone 33 against inner wall 39 of accelerator housing cap 35. Cone 33 is welded to nozzle spokes 30, which are welded to nozzle housing 31. As shown in FIGS. 2 and 4, accelerator cap 35 contains accelerator vanes 40 which direct mixture downward and prevent fluid slippage along inner wall 39 of cap 35. Vanes 40 are shorter near housing 31 than near strut connector 37 to minimize turbulence in mixture upon entry into cap 35. Vanes 40 have height near housing 31 approximating height of liquid level 27. Cap 35, strut connector 37, and housing 38 are connected by a plurality of circumferentially spaced bolts 29.

Figure 2:
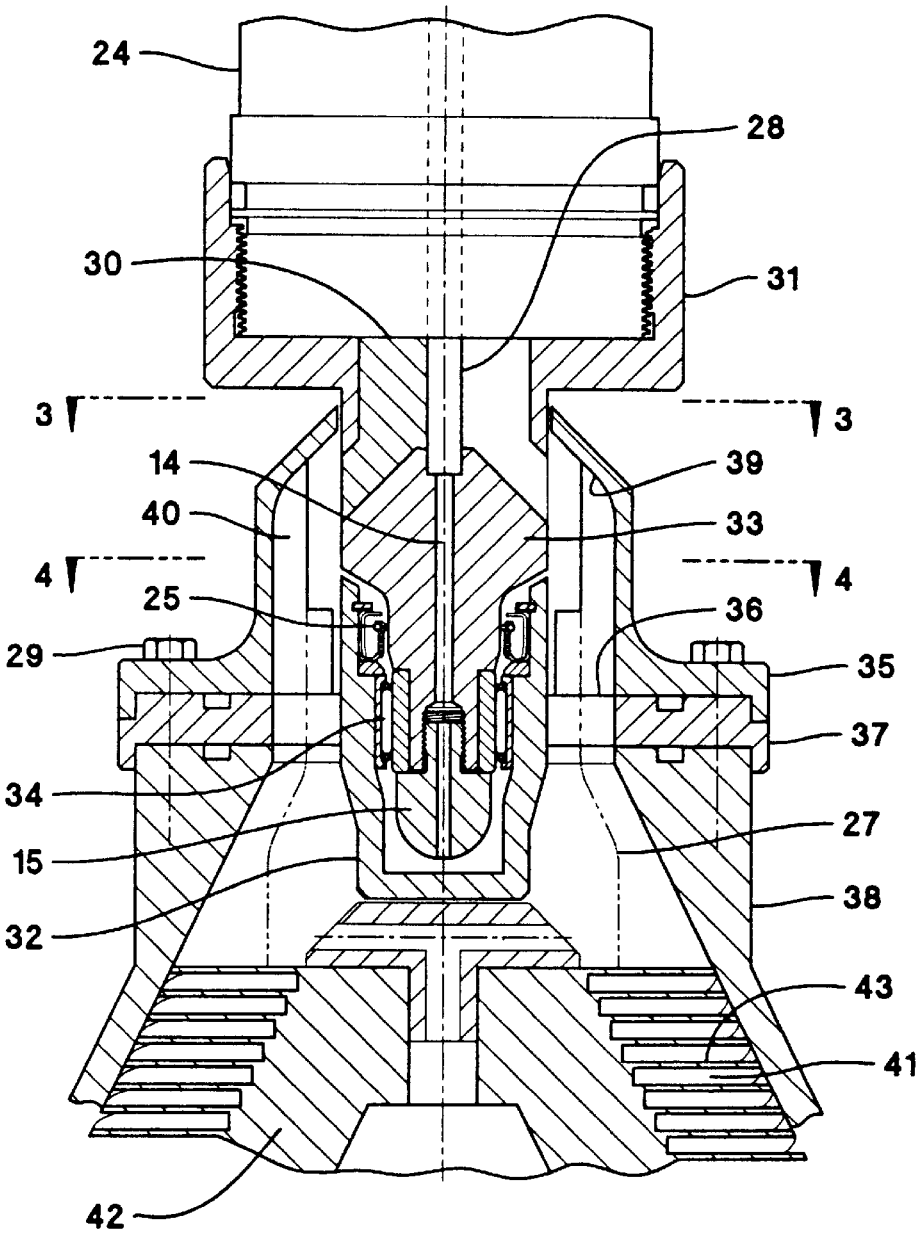
Figure 2A:
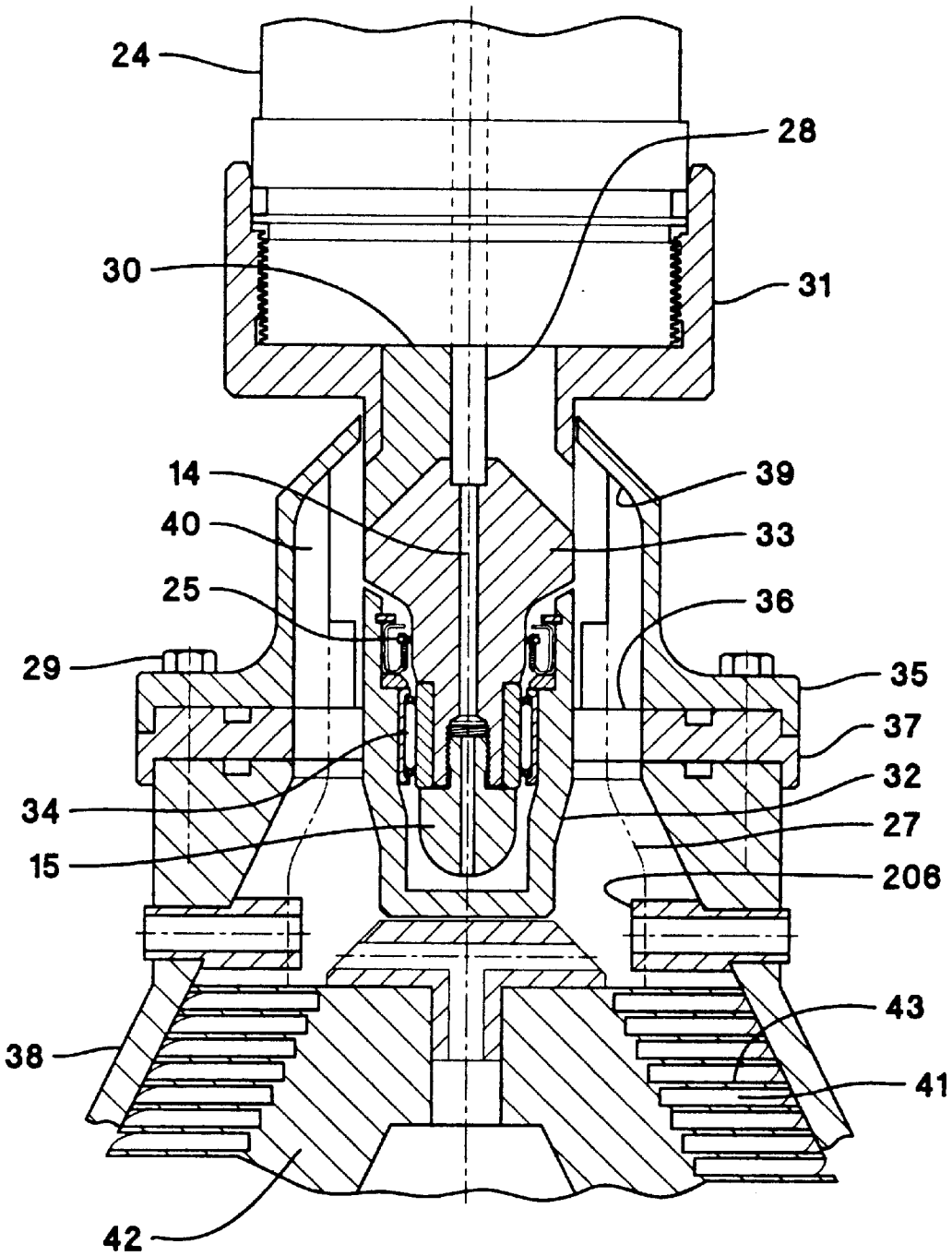
FIG. 2A is the feedpipe nozzle of FIG. 2 in an embodiment which allows separation of solution gas in addition to the separation of the two fluid components of the input mixture.

As shown in FIG. 2A, accelerator housing 38 can also be modified to allow separation of a gas component of the input fluid mixture. Gas will separate from the fluids as the mixture flows along inner wall 39 of cap 35. Separated gas will be vented into rotor 22 by one or more gas vents 206 which penetrate accelerator housing 38. Removal of gas from rotor 22 is through a pressure controlled gas port 208 in the upper portion of feedpipe 24 (FIG. 1). Gas port 208 is connected via piping (not shown) inside feedpipe 24 to a pressure regulating device and a valve which jointly operate to allow gas to exit rotor 22. Such pressure-controlled gas ports are well known in the industry.

Bearings 34 allow relative motion between stationary cone 33 and bearing mount housing 32. Bearing mount housing 32 is connected to strut connector 37 by accelerator struts 36. Bearing holder 15 screws into cone 33 and holds bearings 34 in place on lower portion of cone 33. Seal 25 prevents mixture contact with bearings 34. Bearings 34 are lubricated by lubrication line 28 which is located inside feedpipe 24. Lubrication is pumped from line 28 into passageway 14 and into the cup-shaped cavity formed by housing 32, and is forced upward toward bearings 34 by maintaining a suitable pressure force from line 28.

Figure 5:
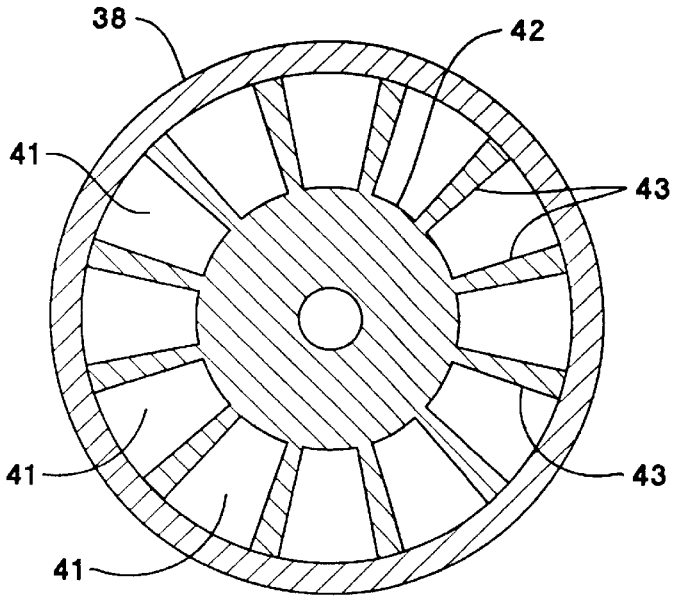
FIG. 5 is a plan view of the first embodiment taken along line 5—5 of FIG. 1.
Figure 6:
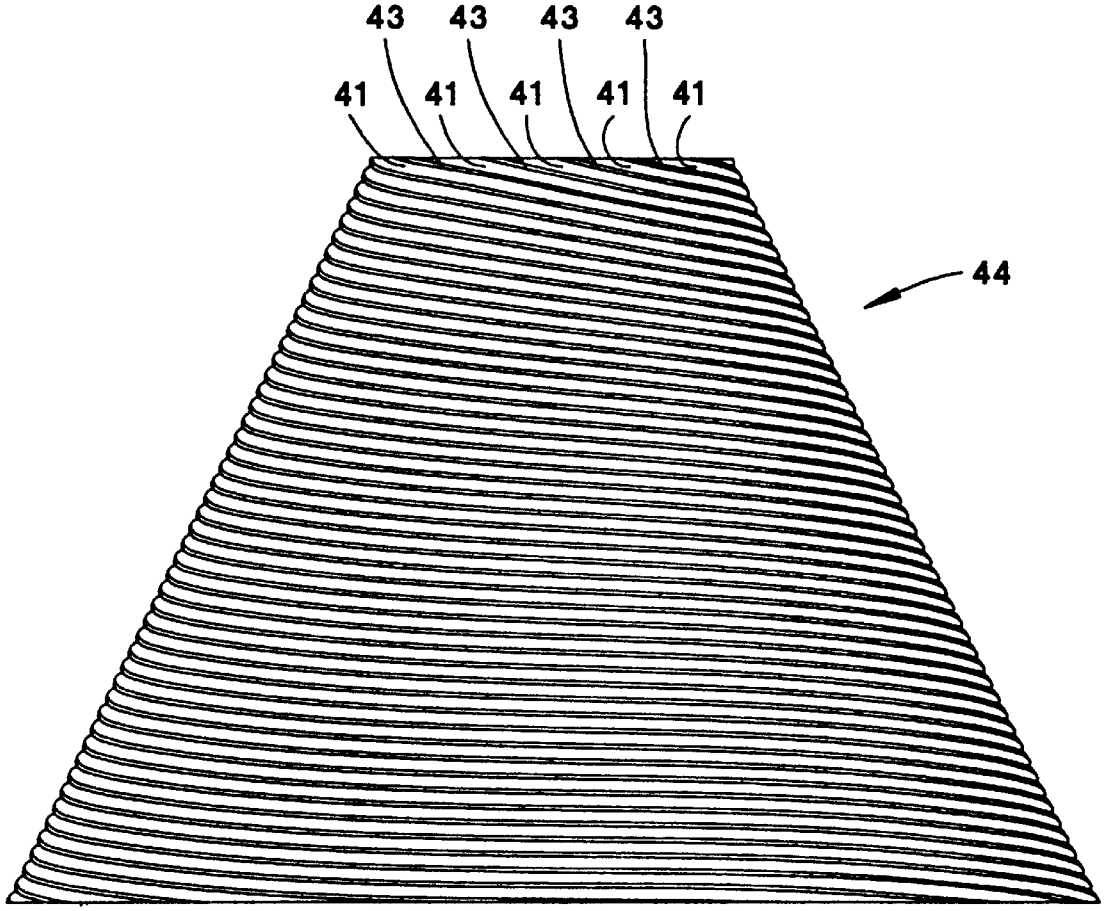
FIG. 6 is an elevation view of the conical fluid accelerator of the first embodiment of the present invention.
Figure 7:
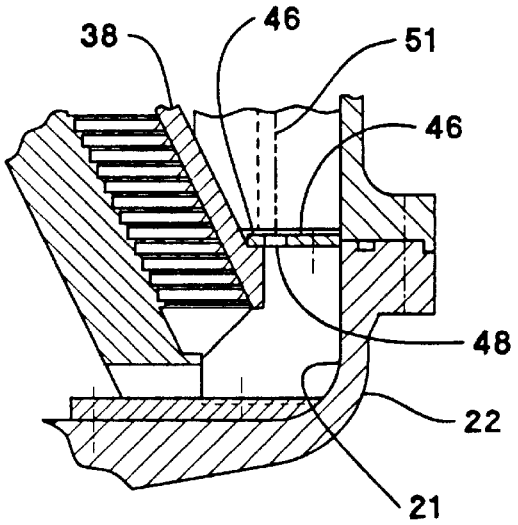

As shown in FIGS. 1 and 6, accelerator housing 38 fits snugly over accelerator assembly 44, which consists of a plurality of concentric helix channels 43 wrapped around an accelerator core 42. In the preferred embodiment, twelve helix channels 43 are mounted on core 42. As shown in FIGS. 1, 5, and 6, mixture flows along inner wall of housing 38, and enters each of the passageways 41 between helix channels 43. Mixture is gradually accelerated by frictional force as mixture flows through passageways 41. Accelerator housing 38 prevents mixture from leaving passageways 41 until mixture flows to the bottom of accelerator assembly 44.

Figure 8:
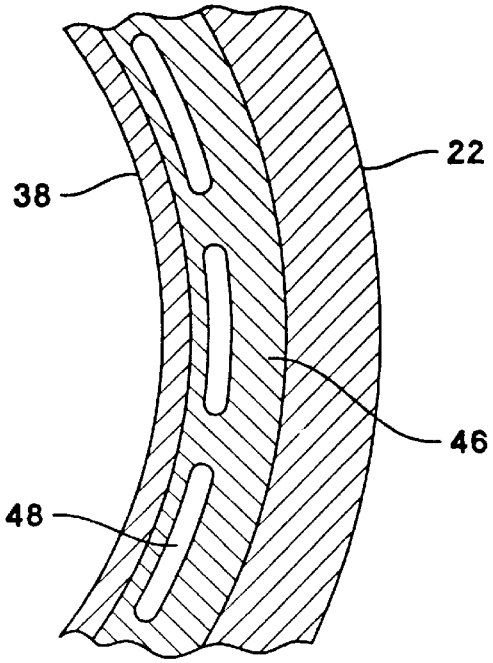
FIG. 8 is an enlarged partial plan view of the feed baffle of FIG. 7.
Figure 9:
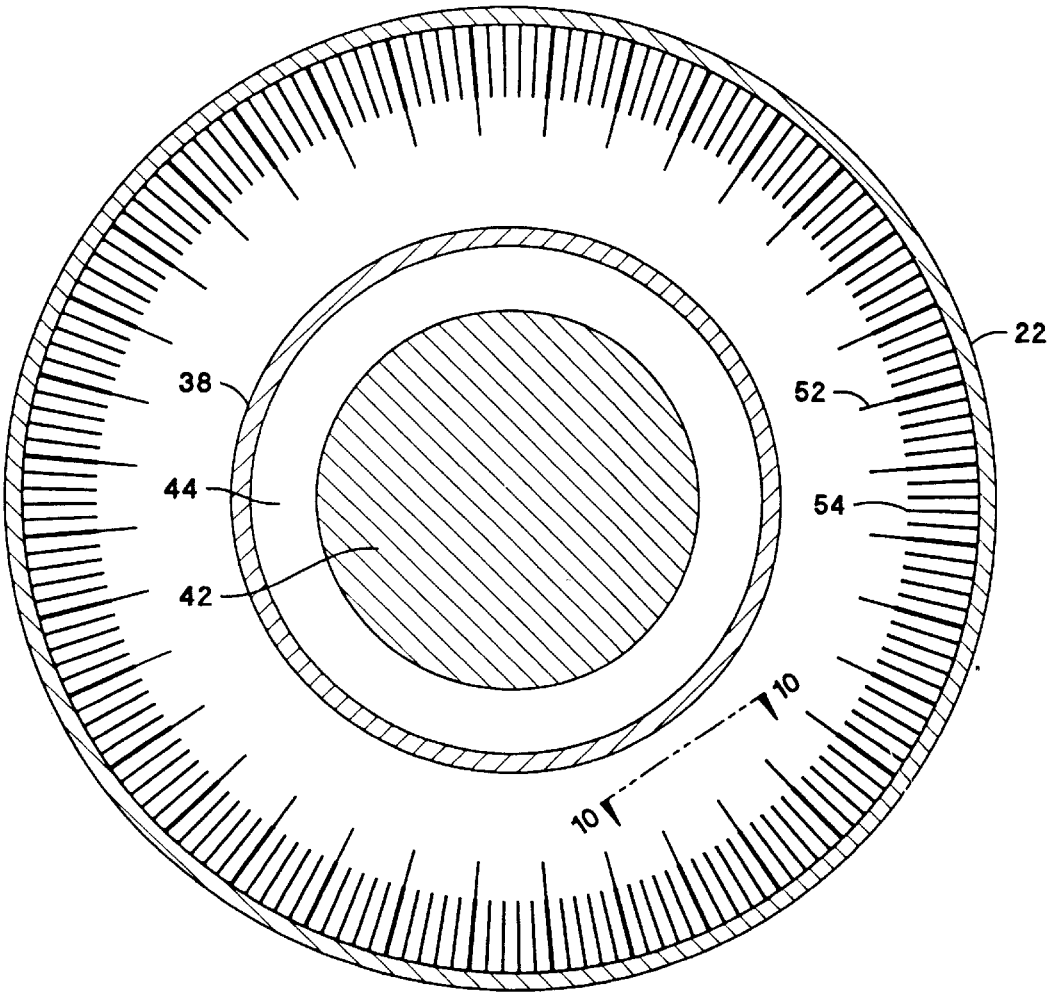
FIG. 9 is a plan view of the first embodiment taken along line 9—9 of FIG. 1.

As shown in FIGS. 1, 7 and 8, accelerator housing 38 is connected to rotor 22 via corner support 49 and feed baffle plate 46. Plate 46 is designed such that openings 48 occur at the distance from inner wall 21 of rotor 22 at which the fluid interface 51 will develop during operation of centrifuge 20. Plate 46 is connected to rotor 22 by welding or other suitable connection means, which may also allow for removal of plate 46 from centrifuge 20 if so desired.

As shown in FIG. 1, mixture flows out of passageways 41 in assembly 44 into lower corner of rotor 22. In addition to connecting housing 38 to rotor 22, corner support 49 prevents mixture slippage along inner wall 21 of rotor 22 and aids flow through openings 48 into upper section of rotor 22.

As shown in FIGS. 1, 9, 10, and 11, the upper section of rotor 22 is subdivided into separation zones by longitudinally-installed surface vanes 52 and interface vanes 54, and laterally-installed zoning baffle plates 56. Preferably, surface vanes 52 alternate with interface vanes 54, with at least one interface vane 54 between each pair of surface vanes 52. In a preferred embodiment, four interface vanes are spaced equidistantly between each pair of surface vanes.

Vanes 54 are preferably fabricated by shaping stainless steel plate into U-shaped sections and installing the sections with the base of the U placed against inner wall 21. Vanes 52 are flat stainless steel plates mounted between adjacent U sections. This method of construction of vanes 52 and vanes 54 is advantageous because the stainless steel plate has sufficient structural strength to withstand the force resulting from rotation of rotor 22.

The height of surface vanes 52 is selected such that the surface of the mixture being separated is slightly below the tip of vanes 52. This design attribute prevents wave-like flow within centrifuge 20 and minimizes fluid mixing. In addition, because the surface vanes 52 are taller than the level of mixture in the inner rotor, the surface vanes substantially prevent the mixture from flowing in a circumferential direction with respect to the inner surface of the hollow rotor. The height of interface vanes 54 is selected such that the position of the interface 51 between the individual components of the mixture is slightly below the tip of vanes 54. This design attribute promotes coalescence of the heavier component into a layer adjacent to inner wall 21 of rotor 22. In addition, because the interface vanes are taller than the level of the heavier component in the inner rotor, the interface vanes substantially prevent the heavier component from flowing in a circumferential direction with respect to the inner surface of the hollow rotor. In addition, the volume between adjacent vanes is minimized, thereby minimizing the occurrence of secondary flows which inhibit coalescence.

Figure 10:
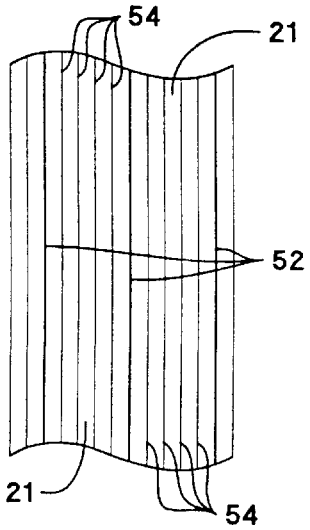
FIG. 10 is a partial elevation view of the surface and interface vanes of the present invention.
Figure 10A:
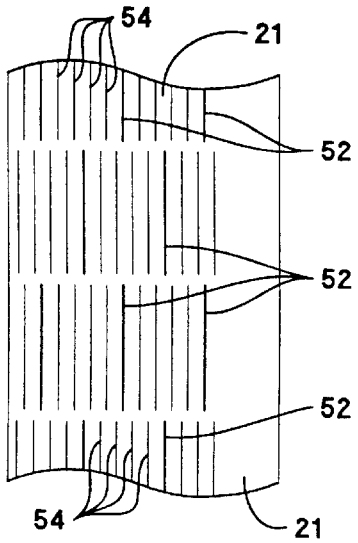
FIG. 10A is a partial elevation view of an alternate embodiment of the surface and elevation vanes of the present invention.

As shown in FIG. 10, vanes 52 and vanes 54 are longitudinally continuous along the inner wall 21 of rotor 22, except at the location of zoning/baffle plates 56. In an alternate embodiment depicted in FIG. 10A, vanes 52 and vanes 54 are installed longitudinally in piecewise staggered sections. This embodiment, which may also include plates 56, increases fluid coalescence by creating flow stagnation points.

Figure 11:
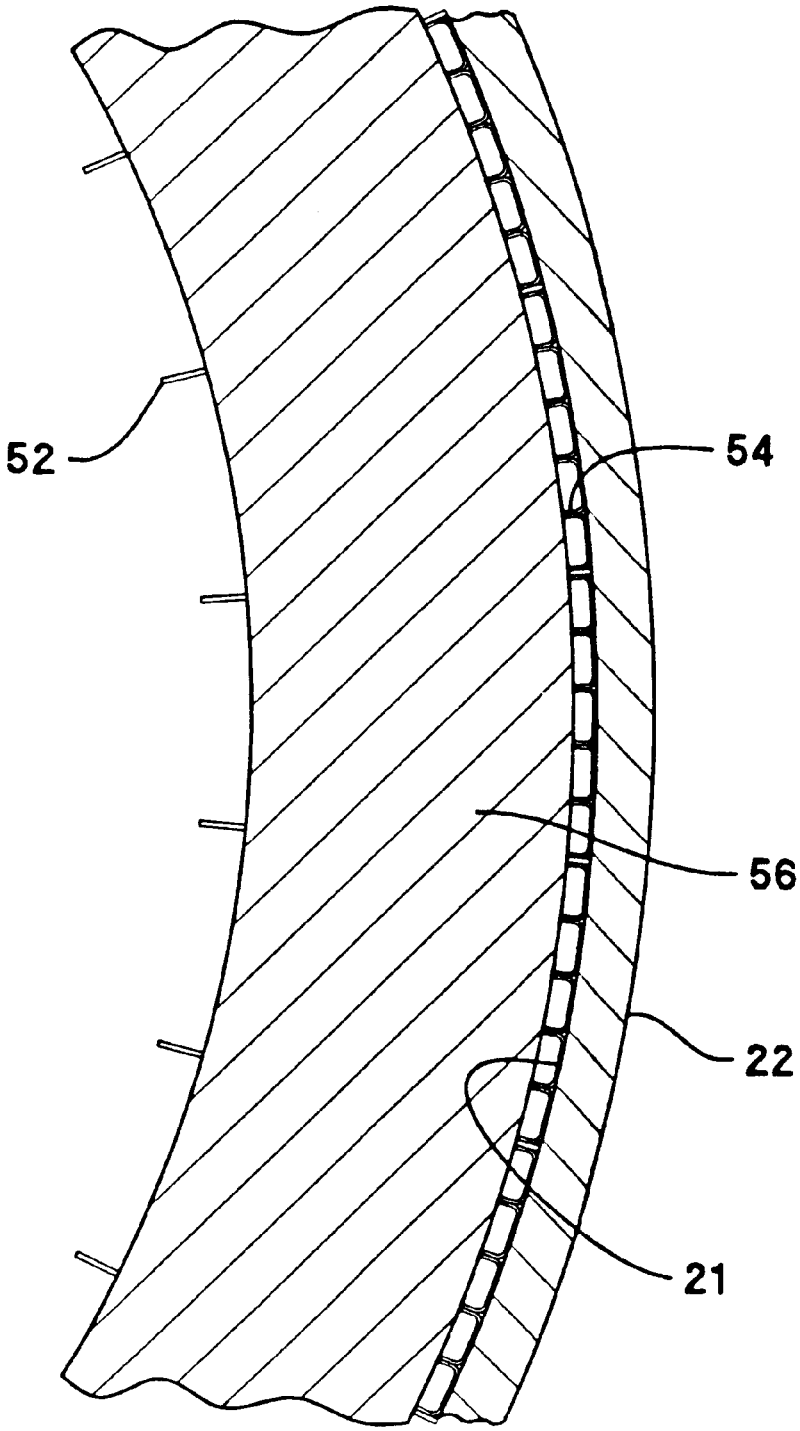
FIG. 11 is a partial plan view of the zoning baffle of the present invention.
Figure 12:
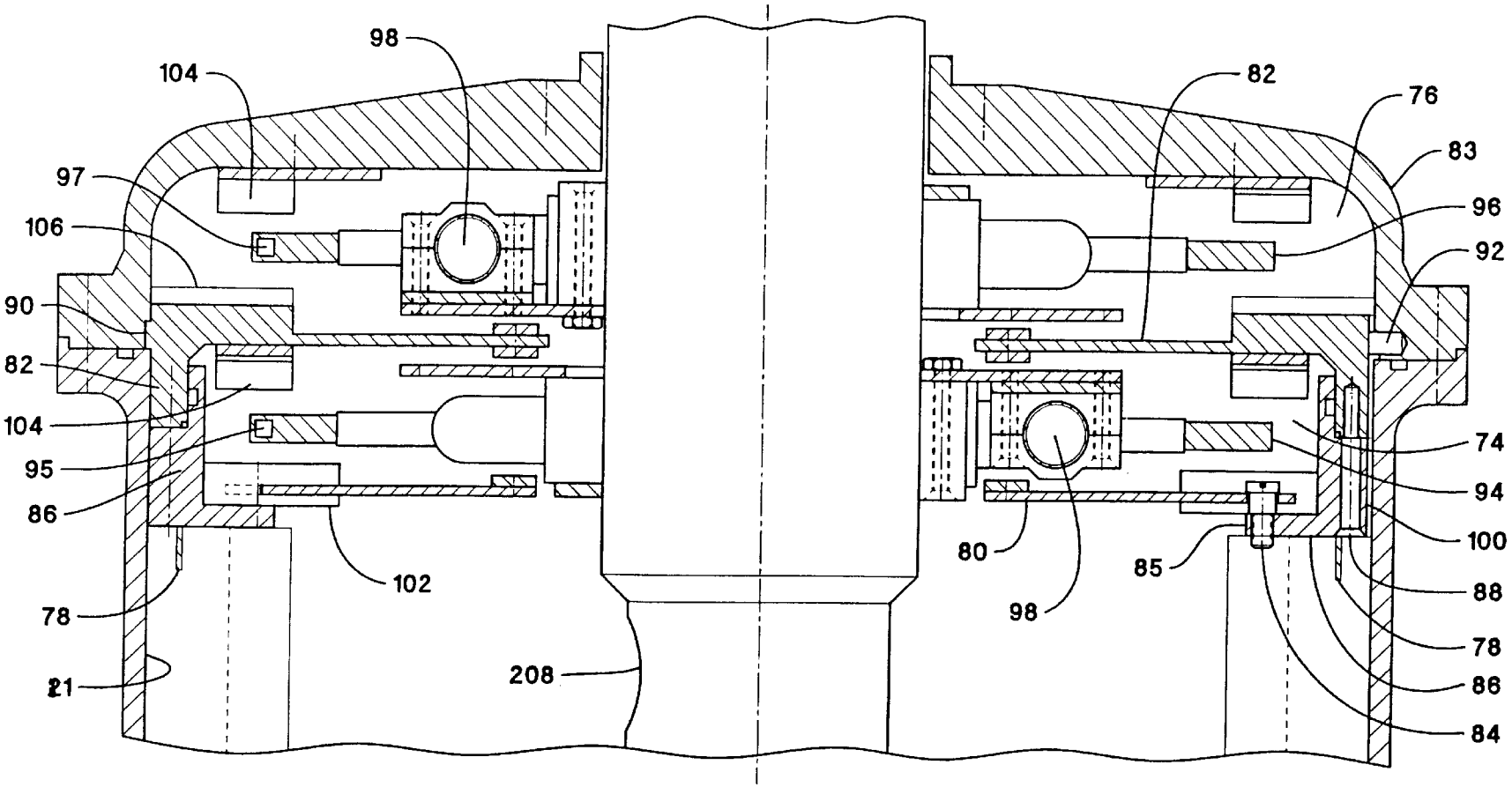

Preferably, one or more annular zoning baffle plates 56 are attached to vanes 52 and vanes 54, as shown in FIGS. 1, and 11. Plates 56 may be either permanently installed or may be removable. Plates 56 are positioned such that the heavier layer, which collects adjacent to wall 21 of rotor 22, flows between wall 21 and plate 56. The lighter layer, which forms away from wall 21 on top of the heavier layer, flows over the inner edge of plate 56. In this way baffle plate 56 minimizes flow near the interface between the layers, thereby minimizing mixing of the fluid components during operation of centrifuge. One or more barrier rings 77 attached to plate 56 may also be used to minimize mixing at the fluid layer interface.

The embodiment shown in FIG. 1 includes a fluid level detector system using floats to detect the thickness of the layers. However, as is well known in the art, any detector system capable of detecting the thickness of the layers may be utilized. The system depicted in FIG. 1 uses a liquid level float 60 attached to liquid level float bolts 58 in a manner allowing float 60 to move radially relative to inner wall 21. Similarly, the system uses an interface float 64 also radially movably attached to interface float bolts 62. Float 60 has a specific gravity less than that of the lighter fluid component of the mixture being separated and thereby rests on the lighter fluid's surface. Float 64 has a specific gravity between the specific gravities of the two fluid components, and thereby rests on the interface between the two layers. Selection of the specific gravity of float 60 and float 64 as stated allows surface sensor 66 and interface sensor 68 to determine the thickness of each of the two layers. Fluid level detector systems such as depicted in FIG. 1 are well known in the art and do not require further discussion. Overflow sensor 70 ensures the fluid level detector system is operating correctly and is also well known in the art.

Removal of fluid from the individual layers within rotor 22 involves standard centrifuge weir techniques well known in the art which do not require detailed discussion. As shown in FIGS. 1 and 12, oil chamber 74 is formed by oil chamber arm 80, oil chamber housing 86, and water chamber arm 82. Arm 80 is connected to housing 86 by circumferentially spaced bolts 84, which are designed to maintain a fluid flow gap between arm 80 and housing 86. Water chamber 76 is formed by water chamber arm 82 and rotor cap 83. Water chamber arm 82 is connected to oil chamber housing 86 by bolt 88. Fluid from the lighter oil layer flows over oil weir 85, between arm 80 and housing 86, into oil chamber 74. Fluid from the heavier water layer flows between wall 100 of housing 86 and inner wall 21 of rotor 22 into water chamber 76. One or more barrier rings 78 prevent transverse flow and mixing across the interface between layers at the location of oil chamber housing 86.

Figure 13:
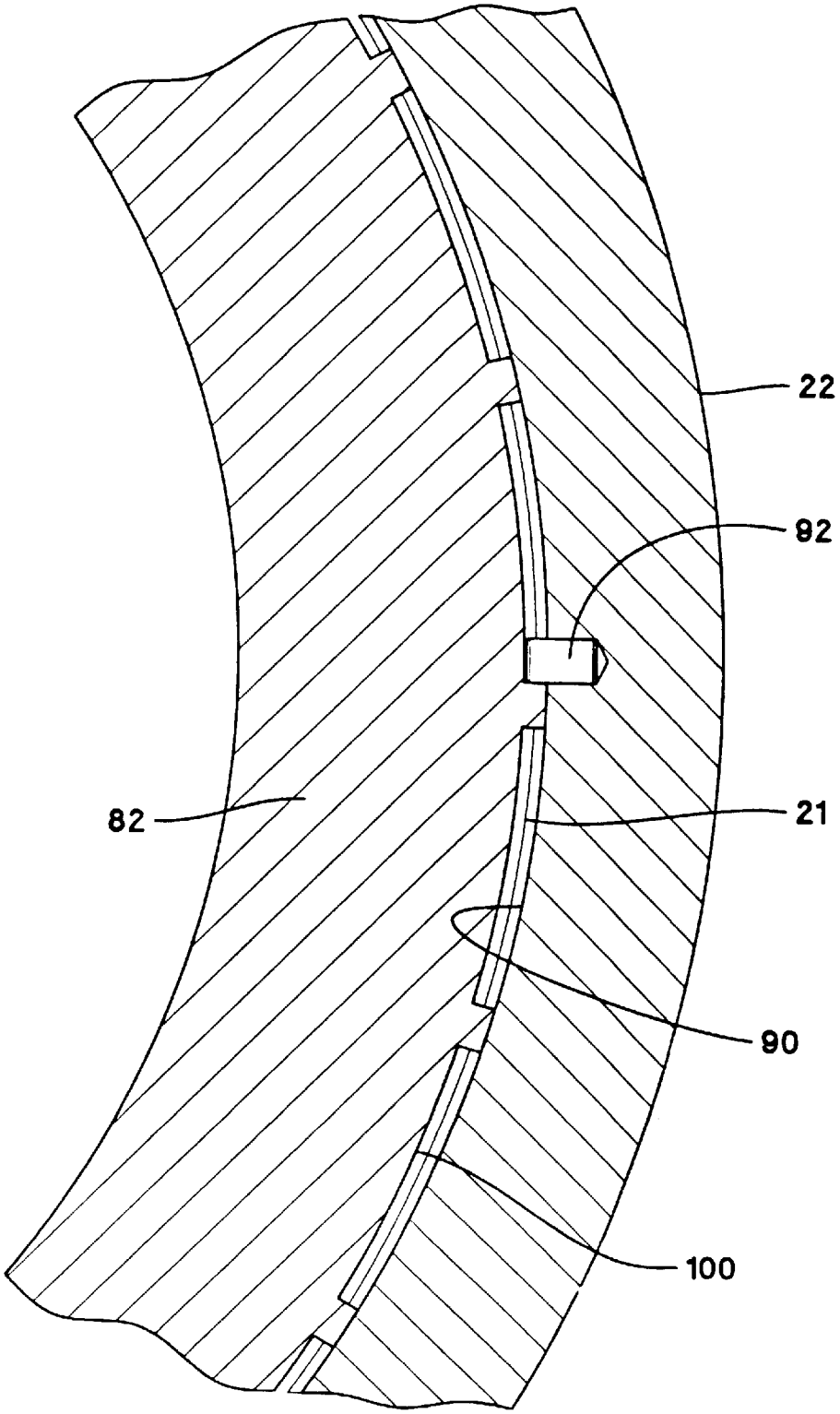
FIG. 13 is an enlarged partial plan view depicting an embodiment of the fluid passageways of the water chamber arm of the present invention.

As shown in FIG. 13, fluid passageways between wall 100 and inner wall 21 occur on the inner circumference of rotor 22. As shown in FIGS. 1, 12 and 13, water chamber arm 82 has a lip 90 inset into rotor 22. Lip 90 allows rotor cap 83 and rotor 22 to hold water chamber arm 82 in place. Fluid is removed from chamber 74 and chamber 76 by oil scoop 94 and water scoop 96 which are held in place by clamps 98 and which have openings 95 and 97 through which fluid flows. Both oil chamber 74 and water chamber 76 have a plurality of fins 102, fins 104 and fins 106 which defeat fluid slippage inside chambers 74 and 76.

In addition to the fluid coalescence attributes noted above, surface vanes 52 and interface vanes 54 also represent an improvement over the art in facilitation of centrifuge washability. Specifically, as shown in FIG. 1, stationary feedpipe 24 includes nozzles 110 which allow fluids to be sprayed into rotor 22 for cleaning of centrifuge 20. The spacing of vanes 52 and 54 and zoning baffles 56 allows substantially complete access to the entire rotor by sprayed cleaning fluids. Prior art centrifuge designs do not allow complete access for cleaning without using relatively widely spaced constant height vanes which do not obtain the separation efficiencies of the present invention. Other separation enhancement mechanisms, such as mesh, are not washable.

Cleaning of passageways 41 in accelerator assembly 44 is accomplished by pumping cleaning fluids through feedpipe nozzle 26 into assembly 44. Dissolved matter, if present, is removed from rotor 22 in solution through chambers 74 and 76.

Figure 14:
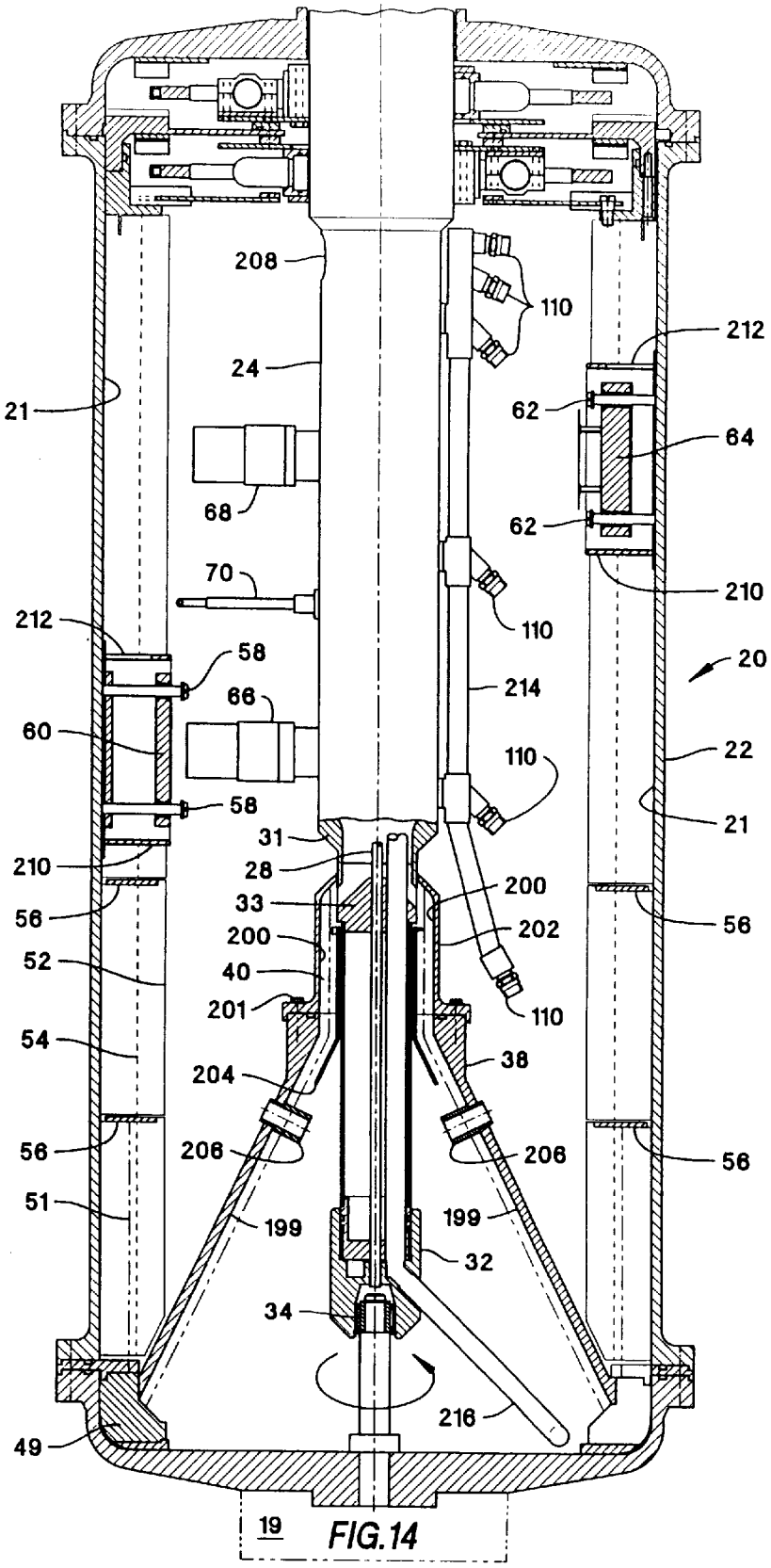
FIG. 14 is an elevation view, in partial section, of a second embodiment of the present invention.

A second embodiment of the present invention is shown in FIG. 14. This embodiment is particularly suited for applications in which larger quantities of wax or other dissolved matter, or sand or other particulates are expected to be present in the input mixture. It also is adapted to allow separation of a solution gas component of the input mixture.

Operation of this embodiment is generally similar to operation of the first embodiment discussed above, with the following alterations. Mixture to be separated is directed by nozzle cap 33 against inner wall 200 of accelerator housing extension 202. Extension 202 is attached to housing 38 by bolts 201. Inner wall 200 contains vanes 40 to direct mixture downward and prevent fluid slippage along wall 200. Vane shield 204 also directs the flow of mixture. The inner wall 199 of housing 38 may also contain vanes (not shown) to prevent fluid slippage.

As mixture flows along inner wall 200 of housing extension 202 onto inner wall 199 of housing 38, the gas component of mixture will separate from the liquids. Gas will collect in the space below housing 38 and be vented into rotor 22 by one or more vents 206 installed in housing 38. Vented gas will be removed from rotor 22 by gas port 208. Mixture flows along inner wall 199 of accelerator 38 into lower corner of rotor 22. Flow of mixture through feed baffle plate 46 is as described above. Surface vanes 52, interface vanes 54, and zoning baffle plates 56 are also as described above.

The fluid detection system is also as described above, except that both liquid level float 60 and interface float 64 are surrounded by a float wall 210 which prevents accumulation of wax and other matter which may inhibit operation of float 60 or float 64. Vent 212 in downstream portion of wall 210 allows fluid access inside wall 210 to allow sensing of interface and liquid levels.

Cleaning fluids are input to the rotor by nozzles 110. Piping 214 which provides supply fluid for nozzles 110 is external to feedpipe 24, in contrast to the internal piping of the embodiment discussed above. Nozzles 110 provide cleaning fluid access to substantially all vanes and baffles. Cleaning fluid and dissolved matter collect at the bottom of rotor 22, pass back through feed baffle plate 46, and are removed from rotor by debris removal piping 216. Particulate matter, which will accumulate below housing 38 without passing through assembly 45, is also removed by piping 216.

Several series of tests have been performed with a prototype of the centrifuge shown in FIG. 1. The prototype was 14 inches in diameter and 35 inches in height. Surface vanes 52 having a height of 1.638 inches were installed on the inner wall 21 of rotor 22 at a 10 degree circumferential spacing, with four 0.75inch tall interface vanes 54 equidistantly spaced between each pair of surface vanes. Comparison tests of this prototype to a centrifuge having 4.6 degree equidistantly spaced 1.638 inch tall vanes were performed. The oil in water performance improvement for the surface and interface vane arrangement was 28.6% at a flow rate of 1400 barrels per day (71.4% water content), and 87.2% at a flow rate of 2000 barrels per day (50% water content).

A separate series of tests were performed to evaluate the performance of the zoning baffle plates 56. In these tests a single baffle plate 56 was installed circumferentially in rotor 22 at a distance approximately one rotor diameter from the bottom of rotor 22. Surface and interface vanes were also installed in the prototype, and comparisons made to performance without the baffle plate. The oil in water performance improvement for the baffle plate was 58% at a flow rate of 2166 barrels per day (55.6% water) and 53% at a flow rate of 1805 barrels per day (55.6% water).

It will be understood that the invention is not to be unduly limited in the foregoing which has been set forth for illustrative purposes. Various modifications and alternatives will be apparent to those skilled in the art without departing from the true scope of the invention, as defined in the following claims.

What we claim is:

1. An apparatus for separating the components of a mixture of two liquids of different specific gravities, said apparatus comprising:

a) a hollow rotor adapted for rotation about a longitudinal axis, said hollow rotor having an inner wall;

b) means for introducing said mixture into said rotor, said means adapted to gradually accelerate said mixture to the rotational speed of said rotor;

c) means for rotating said rotor about said longitudinal axis, whereby said mixture is separated into a substantially heavier layer adjacent to said inner wall and a substantially lighter layer superimposed on said substantially heavier layer, said substantially heavier layer and said substantially lighter layer having an interface therebetween;

d) means for substantially preventing said mixture from flowing circumferentially along said inner wall of said rotor, said means comprising a plurality of separation zones located on said inner wall of said rotor, said separation zones formed by a plurality of longitudinally mounted surface vanes having a first height and a plurality of longitudinally mounted interface vanes having a second height shorter than said first height, at least one of said interface vanes being mounted between each pair of said surface vanes, each of said surface vanes extending inwardly from said inner wall of said rotor to a point beyond both said heavier layer and said lighter layer, each of said interface vanes extending inwardly from said inner wall of said rotor to a point slightly beyond said interface;

e) means for removing said separated layers from said rotor.

2. The apparatus of claim 1, wherein said separation zones are further subdivided by at least one zoning baffle mounted perpendicular to said vanes, each said baffle connected to said vanes such that said substantially heavier layer flows between a first edge of each said baffle and said inner wall of said rotor and said substantially lighter layer flows over a second edge of each said baffle.

3. The apparatus of claim 2, wherein at least one of said zoning baffles further comprises a barrier ring, wherein said ring prevents fluid mixing across an interface between said layers.

4. The apparatus of claim 1, wherein said introducing means comprises a generally conical fluid accelerator connected to said rotor, said accelerator having a plurality of closed helical channels adapted to disperse said mixture into said rotor.

5. The apparatus of claim 4, wherein said introducing means further comprises a stationary feedpipe having a nozzle to disperse said mixture into said accelerator near said longitudinal axis.

6. The apparatus of claim 5, wherein an accelerator cap is connected to said conical fluid accelerator and wherein cap vanes are mounted on an inner wall of said cap, said cap vanes mounted so as to funnel said mixture from said nozzle into said helical channels.

7. The apparatus of claim 3, wherein said feedpipe further comprises at least one wash nozzle for spraying cleaning fluids into said rotor.

8. The apparatus of claim 5, wherein said mixture also contains gas, said accelerator further comprising at least one gas vent to vent gas into said rotor, said feedpipe further comprising at least one gas port to remove said gas from said rotor.

9. The apparatus of claim 4, wherein said introducing means further comprises a feed baffle plate mounted on said inner wall of said rotor proximate to a point at which said mixture is dispersed into said rotor, said plate having openings through which said mixture flows.

10. The apparatus of claim 1, further comprising at least one barrier ring mounted within said rotor proximate a location at which said layers are removed from said rotor.

11. The apparatus of claim 1, wherein said vanes are installed longitudinally in piecewise staggered sections.

12. The apparatus of claim 1, wherein said mixture also contains gas, said gas accumulating in said hollow portion of said rotor during said rotation, said means for removing said separated layers from said rotor further comprising means for removing said gas from said hollow portion of said rotor.

13. The apparatus of claim 1, wherein said introducing means comprises a generally conical fluid accelerator shell connected to said rotor, said accelerator shell having a cylindrical upper extension with inwardly extending extension vanes, said introducing means further having a nozzle cap and a vane shield which act to direct the flow of said mixture.

14. The apparatus of claim 13 wherein said shell has inwardly extending shell vanes which guide said mixture along an inner wall of said shell.

15. The apparatus of claim 13, wherein said introducing means further comprises a stationary feedpipe having a nozzle to disperse said mixture into said accelerator shell near said longitudinal axis.

16. The apparatus of claim 15, wherein said mixture further contains gas, said shell further comprising at least one gas vent to vent gas into said rotor, said feedpipe further comprising at least one gas port to remove said gas from said rotor.

17. The apparatus of claim 15, wherein said mixture also contains particulate matter, said feedpipe further comprising debris removal piping extending through said feedpipe into said shell for removing said matter from said shell.

18. The apparatus of claim 13, wherein said introducing means further comprises a feed baffle plate mounted on said inner wall of said rotor proximate to a point at which said mixture is introduced into said rotor, said plate having openings through which said mixture flows.

19. The apparatus of claim 13, wherein said feedpipe further comprises at least one wash nozzle for spraying cleaning fluids into said rotor.

20. The apparatus of claim 13, wherein said mixture also contains gas, said gas accumulating in said hollow portion of said rotor during said rotation, said means for removing said separated layers from said rotor further comprising means for removing said gas from said hollow portion of said rotor.

21. The apparatus of claim 13, wherein said mixture in addition contains particulate matter, said rotor further comprising means for removing said matter from said shell.

22. An apparatus for separating the components of a mixture of two liquids of different specific gravities, said apparatus comprising:

a) a hollow rotor adapted for rotation about a longitudinal axis and having an inner wall subdivided into fluid separation zones by a plurality of longitudinally mounted surface and interface vanes, wherein four interface vanes are mounted between each pair of surface vanes and further by at least one zoning baffle mounted perpendicular to said vanes;

b) a generally conical fluid accelerator connected to said rotor, said accelerator having a plurality of helical channels adapted to disperse said mixture into said rotor and further having a feed baffle attached to said rotor proximate to a point at which said mixture is dispersed into said rotor, said feed baffle having openings through which said mixture flows;

c) a stationary feedpipe having a nozzle to introduce said mixture into said accelerator near said longitudinal axis, said feedpipe further having at least one wash nozzle for spraying cleaning fluids into said rotor;

d) means for rotating said rotor about said axis, thereby separating said liquids into a substantially heavier layer and a substantially lighter layer, said heavier layer flowing between an outer edge of each said zoning baffle and said inner wall of said rotor and said lighter layer flowing over an inner edge of each said zoning baffle; and e) means for removing said separated layers from said rotor.

23. An apparatus for separating the components of a mixture of two liquids of different specific gravities, and gas in solution, said apparatus comprising:

a) a hollow rotor adapted for rotation about a longitudinal axis and having an inner wall subdivided into fluid separation zones by a plurality of longitudinally mounted surface and interface vanes, wherein four interface vanes are mounted between each pair of surface vanes and further by at least one zoning baffle mounted perpendicular to said vanes;

b) a generally conical fluid accelerator shell connected to said rotor, said shell having a cylindrical upper extension with a plurality of inwardly extending extension vanes, said shell adapted to disperse said mixture into said rotor, said shell further having a feed baffle mounted on said rotor proximate to a point at which said mixture is dispersed into said rotor, said feed baffle having openings through which said mixture flows, said shell further having at least one gas vent to vent gas into said rotor;

c) a stationary feedpipe having a nozzle to introduce said mixture into said accelerator shell near said longitudinal axis, said feedpipe further having at least one wash nozzle for spraying cleaning fluids into said rotor, and having at least one gas port to remove said gas from said rotor;

d) means for rotating said rotor about said axis, thereby separating said liquids into a substantially heavier layer and a substantially lighter layer, said heavier layer flowing between an outer edge of each said zoning baffle and said inner wall of said rotor and said lighter layer flowing over an inner edge of each said zoning baffle; and e) means for removing said separated layers from said rotor.

* * * * *